US005492516A

United States Patent [19]

Trotter

[11] Patent Number: 5,492,516

[45] Date of Patent: Feb. 20, 1996

[54] EXERCISE APPARATUS FOR USE WITH BICYCLES

[76] Inventor: Edward E. Trotter, 4545 Gandy Blvd., Tampa, Fla. 33611

[21] Appl. No.: 451,220

[22] Filed: May 26, 1995

[51] Int. Cl.[6] ..... A63B 69/16

[52] U.S. Cl. ..... 482/57; 482/61

[58] Field of Search ..... 482/57, 61, 146, 482/58, 59, 60, 64, 63, 65; 434/61, 247

[56] References Cited

U.S. PATENT DOCUMENTS

| | | | |
|---|---|---|---|
| 584,989 | 6/1897 | Davis | 482/61 |
| 4,061,460 | 12/1977 | George | 482/57 |
| 4,593,898 | 6/1986 | McLerran et al. | 272/73 |
| 4,726,503 | 2/1988 | Bowker | 226/188 |
| 4,750,737 | 6/1988 | Smith | 482/61 |
| 4,802,666 | 2/1989 | Rodgriquez | 272/73 |
| 4,932,651 | 6/1990 | Defaux | 482/61 |
| 5,413,545 | 5/1995 | Bermann | 482/146 |

FOREIGN PATENT DOCUMENTS

| | | |
|---|---|---|
| 104349 | 5/1898 | Germany . |

*Primary Examiner*—Stephen R. Crow
*Attorney, Agent, or Firm*—Pettis & McDonald

[57] ABSTRACT

An apparatus to which bicycles may be attached for indoor training and conditioning of cyclists. The exercise apparatus includes a pair of turntables rotatably mounted to a frame and a mounting device slidably connected to the frame. The mounting device is designed to receive a bicycle thereon so that each of the tires of the bicycle engage a turntable. A rider by steering the front wheel will cause the bicycle to move inwardly or outwardly on the turntable increasing or decreasing the moment arm of the force applied by the bicycle tire on the adjacent turntable as the bicycle is pedaled.

11 Claims, 11 Drawing Sheets

EXERCISE APPARATUS FOR USE WITH BICYCLES

BACKGROUND OF THE INVENTION

1. FIELD OF THE INVENTION

The present invention relates to an exercise apparatus to which most bicycles may be attached for indoor training and conditioning of cyclists.

2. DESCRIPTION OF THE PRIOR ART

Devices for holding a bicycle upright in a stationary position for use indoors as exercise apparatus are well known in the art. Most such devices provide a means for applying adjustable resistance to one of the wheels of the bicycle in order to increase the force required to pedal and thereby obtain more stressful exercise. The majority of such devices, for example, U.S. Pat. No. 4,493,898 issued to McLerran, et al., U.S. Pat. No. 4,802,666 issued to Michael Rodriqguez, and U.S. Pat. No. 584,989 issued to Isaac Davis, each disclose a method for increasing the resistance to rotation of the rear tire of the bicycle. These methods include, respectively, changing the length of the moment arm when the bicycle tire is applied to a vertical rotatable disk, increasing or decreasing the force of a brake mechanism applied to a roller on which the bicycle rides and adding weight to the rotating platform. Each of these exercise devices require the operator to dismount from the bicycle to make the adjustment to the resistance.

U.S. Pat. No. 4,932,651 issued Georges Defaux discloses a device that has a handle located near the pedals that must be rotated to increase the upward force of the rollers against the tires. This device requires the cyclist to disengage at least one hand from the handle bars to make such an adjustment. Cyclists, when training indoors desire to simulate the actions of riding a bicycle outdoors as closely as possible. These prior designs did not address the dynamic changes in work loads required by the cyclist, nor did those using a rotating platform address the excessive tire wear and noise produced by the friction at the tire contact surface due to the changing radius which produces an "S" shaped resistance at the turntables and tire interface.

Therefore, notwithstanding the existence of such prior art, it remains clear that there is a need for an exercise apparatus that is to be used with a bicycle that permits the rider to sit upon the bicycle and have total variability of work loads during training without having to dismount or remove his or her hands from the handle bars to change the resistance. There is also a need to reduce the tire wear and noise created by many of the prior art devices.

SUMMARY OF THE INVENTION

The present invention relates to an exercise apparatus used with a bicycle that simulates the experience of riding outdoors, including total variability in the length and height of simulated hills, wind resistance, work loads proportional to speed and overcoming the inertia of bicycle and cyclist.

The exercise apparatus of this invention, used in combination with a bicycle having a handle bar, a top tube and a pair of wheels, includes a first and a second turntable that are rotatably mounted to a frame. The turntables are connected to one another for simultaneous rotation when a rotational force is applied to either turntable. A bicycle support means, designed to support most bicycles, is slidably mounted to the frame for movement along a line that extends from a point proximal a line joining the turntable axis outwardly from between the first and second turntables. The turntables and the support means are oriented so that each bicycle wheel engages a corresponding one of the turntables.

By pedaling, a cyclist causes the turntable supporting the bicycle's rear wheel to rotate, which causes the turntable supporting the front wheel to also rotate. The inertia of the turntables and resistance created by air moving through fan blades attached to the turntables are overcome as the cyclist strives to reach a targeted speed. By steering the front wheel toward the axis of rotation of the supporting turntable, the support means slides inwardly between the two turntables. The rear wheel and the front wheel are now engaging the corresponding turntable closer to its axis of rotation, which reduces the moment arm of the force applied to the turntable by the bicycle, thereby increasing the pedaling effort required by the cyclist to maintain the same rate of rotation of the bicycle wheels. The turntable will spin faster, moving more air through the fan blades, which increases the effort required, simulating riding the bicycle up an incline or simulating the energy required to overcome proportional headwinds. Conversely, as the support means moves outwardly, away from the centerline, the moment arm increases reducing the effort required by the cyclist, to maintain the same rate of rotation of the bicycle wheel. The cyclist benefits from the inertia of the disc which keeps the bicycle wheels rolling without pedaling, similar to conditions outside.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION

Figure 1:
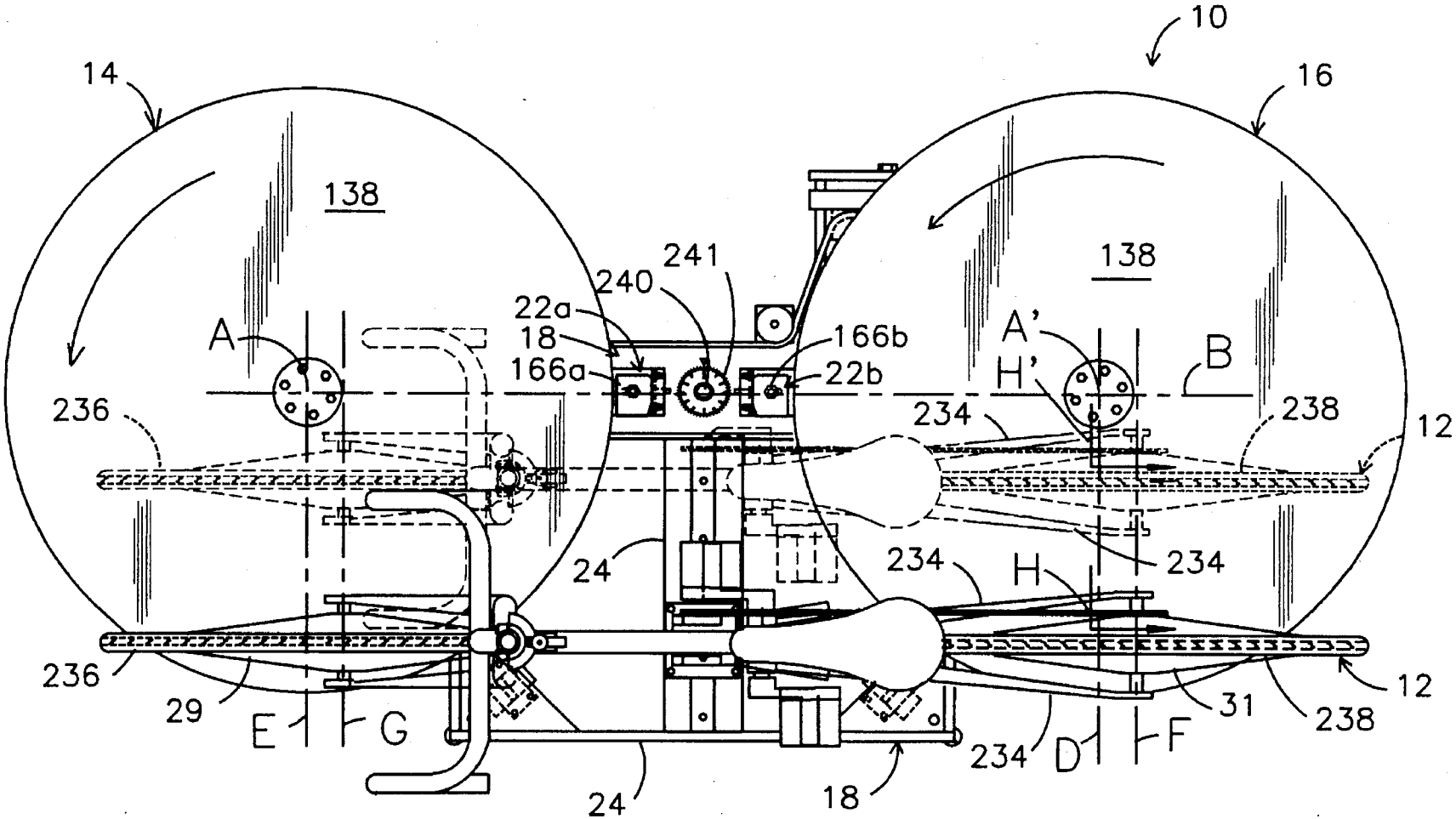
FIG. 1 is a plan view of the exercise apparatus of this invention with a bicycle shown mounted thereon in a first position and in phantom in a second position.
Figure 2:
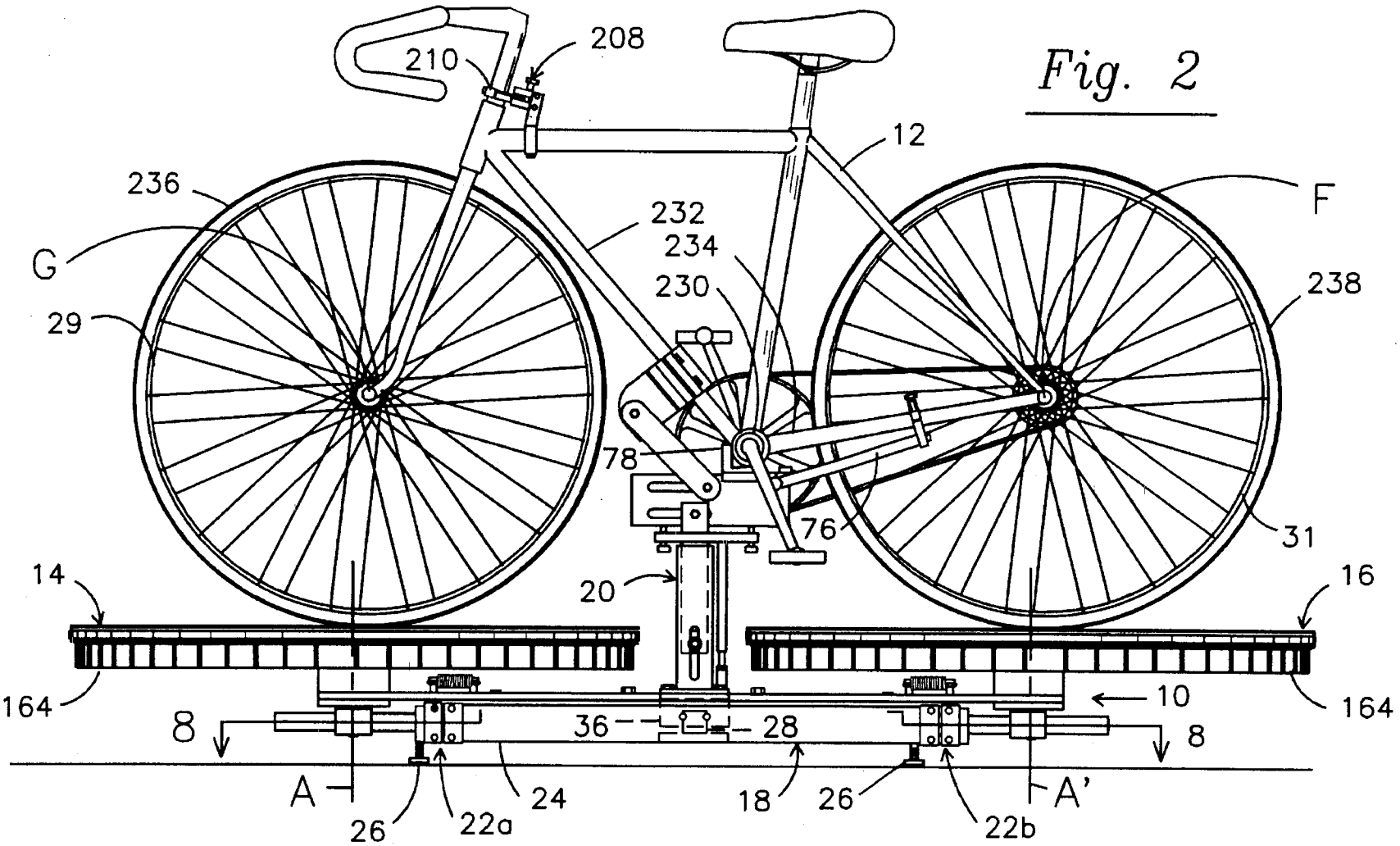
FIG. 2 is a front elevational view of the invention of FIG. 1.
Figure 3:
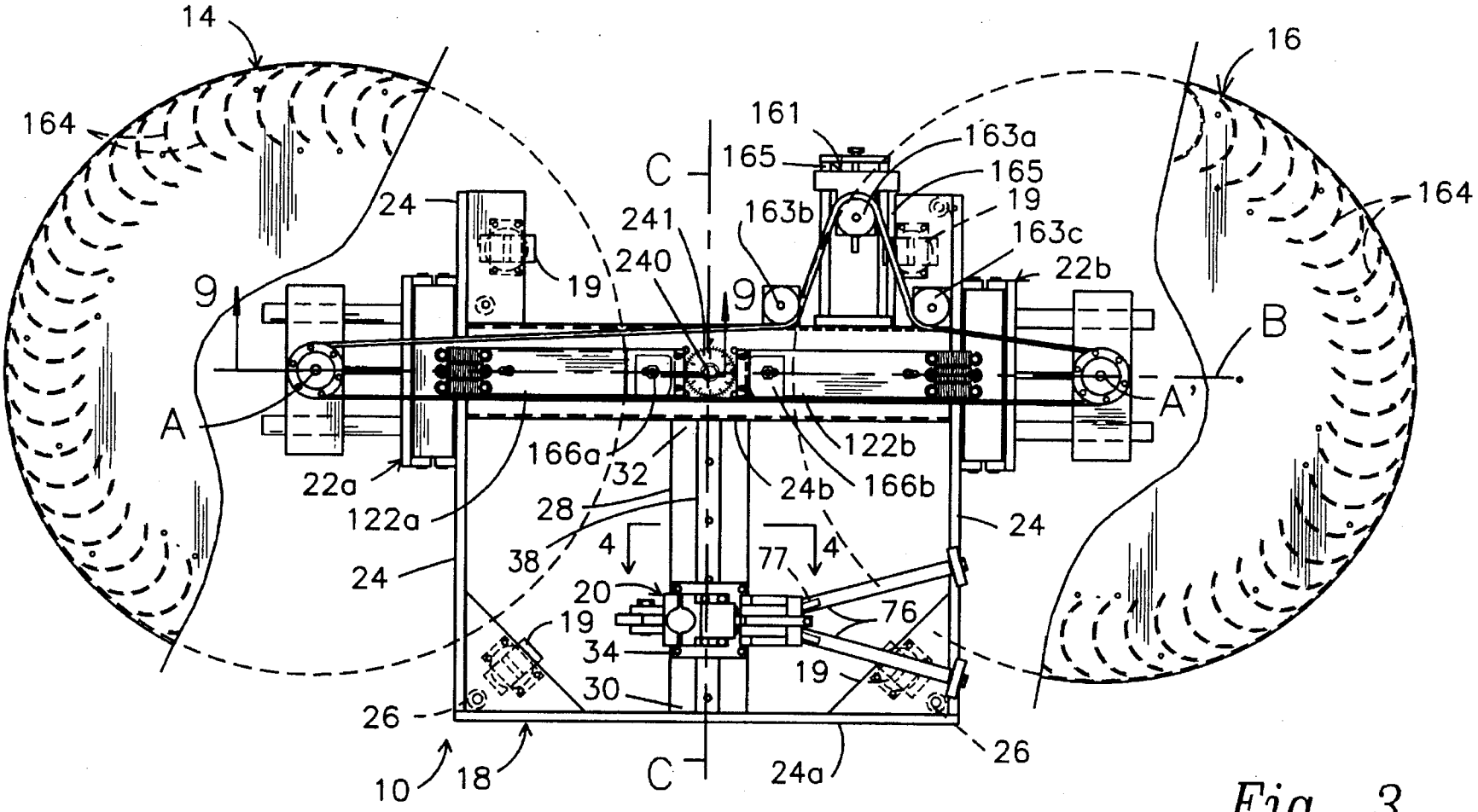
FIG. 3 is a plan view of the apparatus of FIG. 1 with the turntables shown in phantom to more clearly illustrate the structure thereunder.
Figure 4:
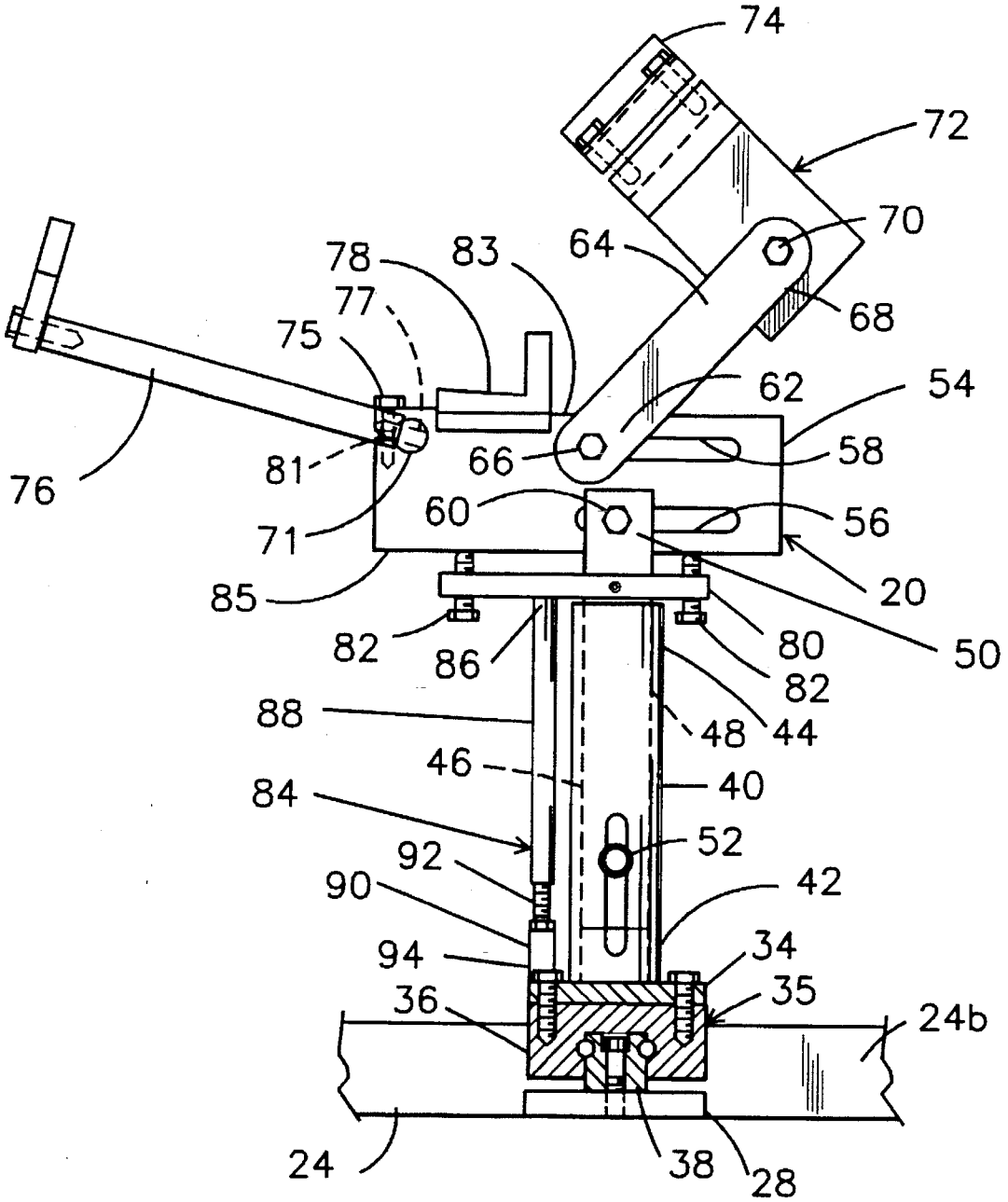
FIG. 4 is a cross sectional view taken along lines 4—4 of FIG. 3.

A preferred embodiment for the exercise apparatus of this invention is illustrated in the drawing FIGS. 1–12 in which the exercise apparatus is generally indicated as 10. A bicycle is illustrated as being attached to the exercise apparatus in FIGS. 1 and 2. and is generally indicated as 12. Referring first to the view of FIG. 1, it can be seen that the exercise apparatus 10 comprises a first turntable 14, a second turntable 16 and a frame 18. In FIG. 2 it can be seen that the exercise apparatus 10 further comprises support means generally indicated as 20, for supporting the bicycle 12, and lifting means, generally indicated as **22*a* and 22*b*. The frame 18 is comprised of a plurality of structural members 24 to which are attached adjustable feet 26 for leveling the frame 18 when placed on an uneven floor. Four swivel casters 19, as seen in FIG. 3, are bolted to frame 18 to facilitate moving the exercise apparatus from place to place, when the adjustable feet 26 are in an up position. As shown in FIGS. 3 and 4, a portion of the frame 18 comprises a rail support member 28, that extends generally normal to the center line B that passes through the vertical axis A and A' of the turntables 14 and 16 respectively. The first end 30 and the second end 32 of the rail support member 28 are attached to structural members 24*a* and 24*b* respectively of frame 18. The rail support member 28** is positioned so that its longitudinal axis C is generally centered between the axes A and A'.

As can be seen in FIG. 4, a linear bearing 35 that is comprised of a bearing carriage 36 and a bearing rail 38 is mounted longitudinally on the rail support member 28. In a preferred embodiment, the linear bearing 35 is a Thompson Accuglide bearing, part no. DG25 AABN; however, any other linear bearing suitable for the purpose may be used.

As shown in FIGS. 3 and 4, the support means 20 is slidably mounted on the rail support member 28 so that it may be selectively moved between an inner position, defined as proximal the second end 32, and an outer position, defined as proximal to the first end 30, along bearing rail 38. In FIG. 1 the bicycle 12 is shown with its front and rear wheels, 29 and 31 respectively in the outer position, contacting the turntables 14 and 16, respectively, proximal to their periphery. The bicycle 12 is shown in phantom in the inner position, proximal to the vertical axes A and A'.

As shown in FIG. 4, the support means 20 comprises a base 34 that is bolted to a linear bearing 35. A sleeve 40, having a first end 42 and a second end 44, is welded by its first end 42 to the base 34 so that the second end 44 extends upwardly therefrom. The first end 46 of a shaft 48 is received into the second end 44 of the sleeve 40, so that the second end 50 of the shaft 48 can be extended therefrom. A locking bolt 52 is threadably attached to shaft 48 so that bolt 52 may slide within elongated aperture 53 and be tightened against the sleeve 40 locking the shaft 48 within the shaft 48. A vertically oriented mounting plate 54 has a first horizontal slot 56 and a second horizontal slot 58. The second end 50 of the sleeve 40 is slidably bolted to the first slot 56 of the mounting plate 54. The bolt 60 may be tightened to lock the mounting plate 54 in a fixed position. The first end 62 of a support arm 64 is slidably bolted to the mounting plate 54 by bolt 66 that passes through the second slot 58. The second end 68 of the arm 64 is bolted by bolt 70 to a clamp 72, which is comprised of a first part 73 and a second part 74 that is bolted to the first part 73. Mounting plate 54 has a hole 69 therethrough that receives a rod 71 therein. Two studs 77, one on each side of the plate 54, are threadably mounted in the rod 71 at approximately a 20° to a 30° angle. Each stud 77 is threadably attached to a leg 76 that extends outwardly from the mounting plate 54. Bolt 75 clamps shaft 71 and legs 76 at the desired angle. An angle 78 is attached to the top portion 83 of the mounting plate 54. The second end 50 of the shaft 48 passes through a leveling plate 80 and is attached thereto by setscrew 79 so that the leveling plate 80 is generally horizontal. A pair of leveling screws 82 are threadably mounted to the leveling plate 80 and extend upwardly to engage the bottom 85 of the mounting plate 54 for leveling purposes. A support means reference post 84 is attached by its first end 86 to the leveling plate 80. The reference post 84 comprises a tube 88 that has threads therein and a sleeve 90 that has a portion with threads 92 thereon that threadably engage the tube 88. By rotating rod 90 the support reference post 84 may be extended or retracted. The second end 94 of the support reference post may engage the base 34.

Figure 5:
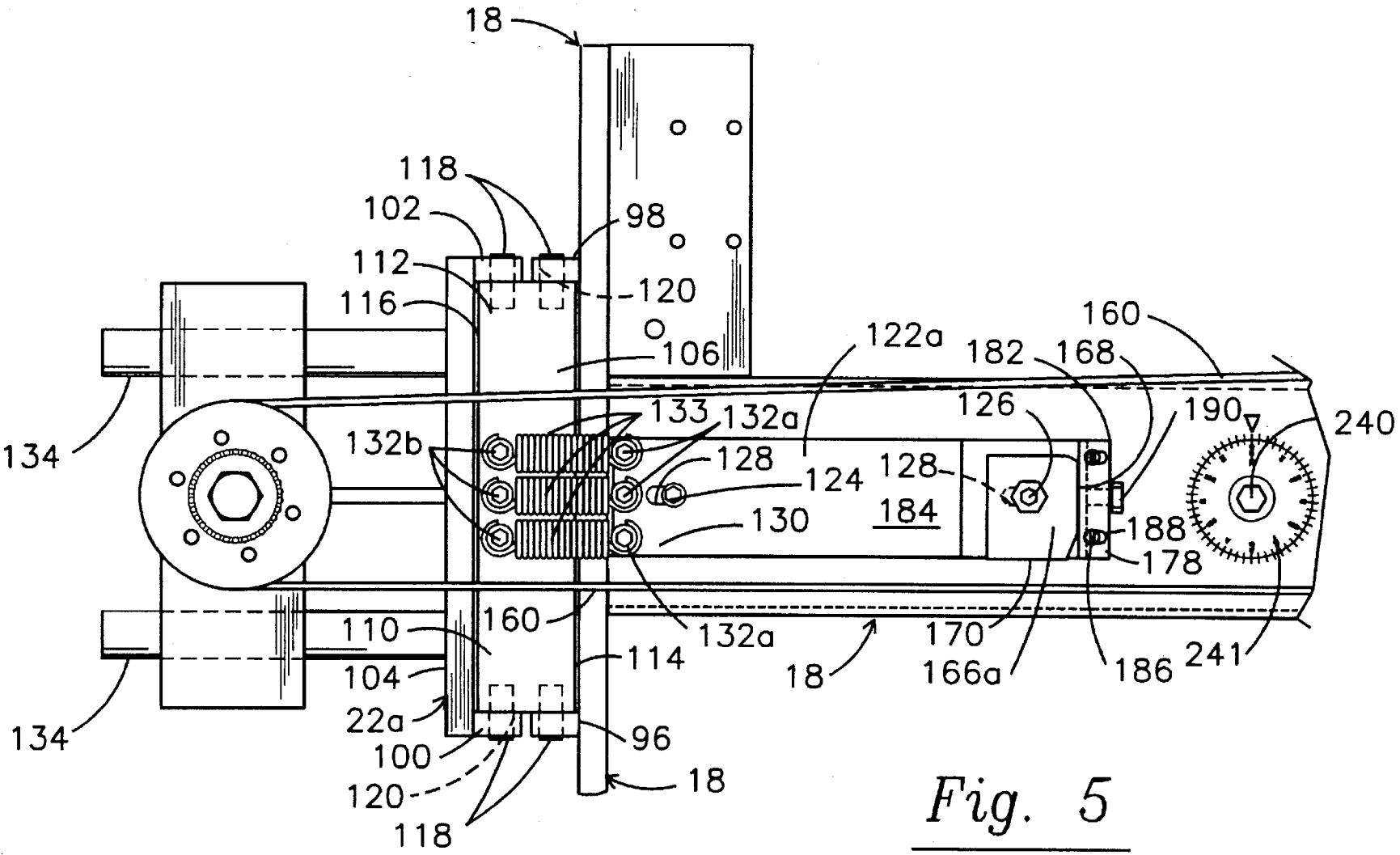
FIG. 5 is a detailed plan view of a portion of the apparatus of FIG. 3 illustrating the cam in the setup position.
Figure 6:
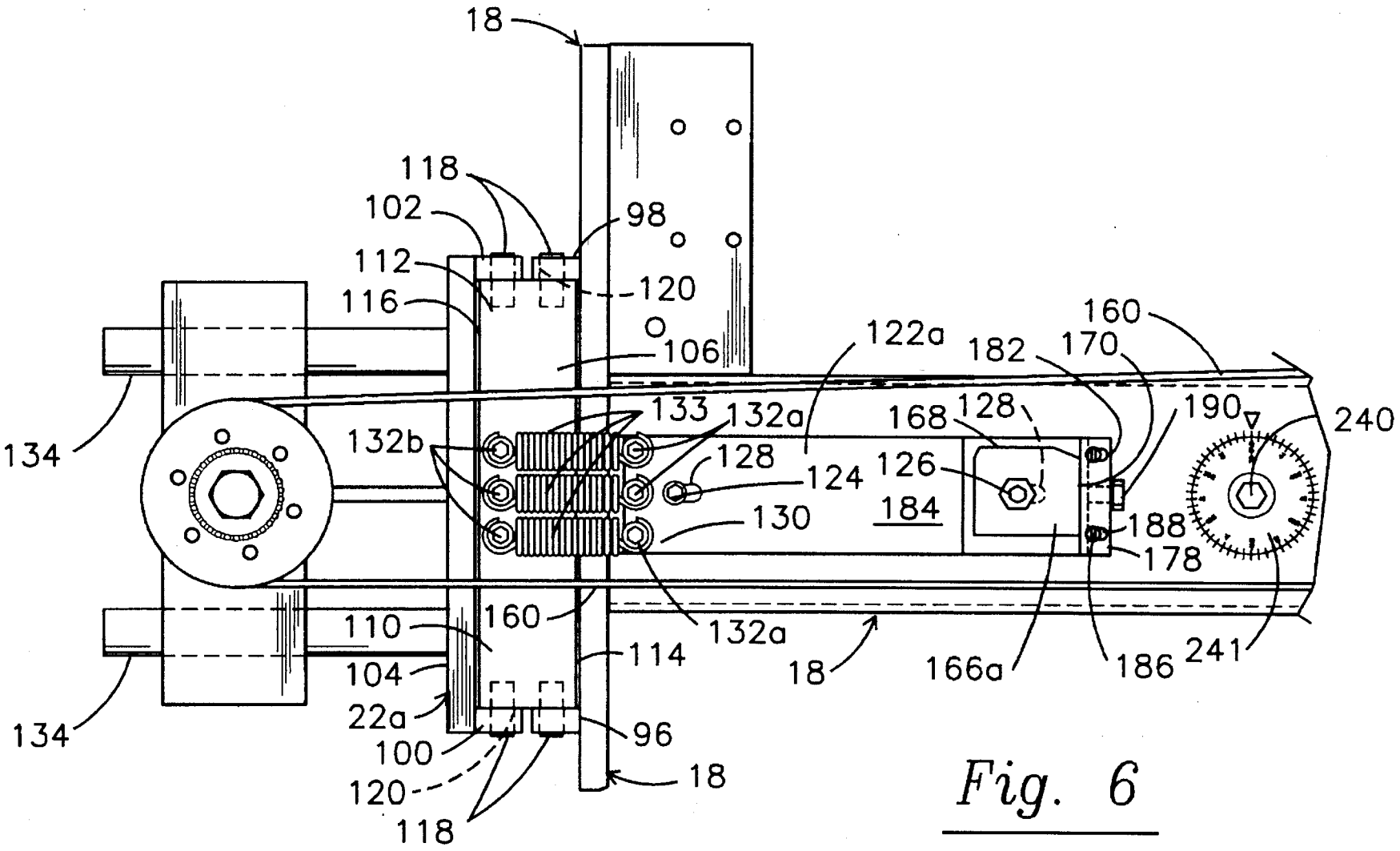
FIG. 6 is the detailed plan view of FIG. 5 illustrating the cam in the up position.
Figure 7:
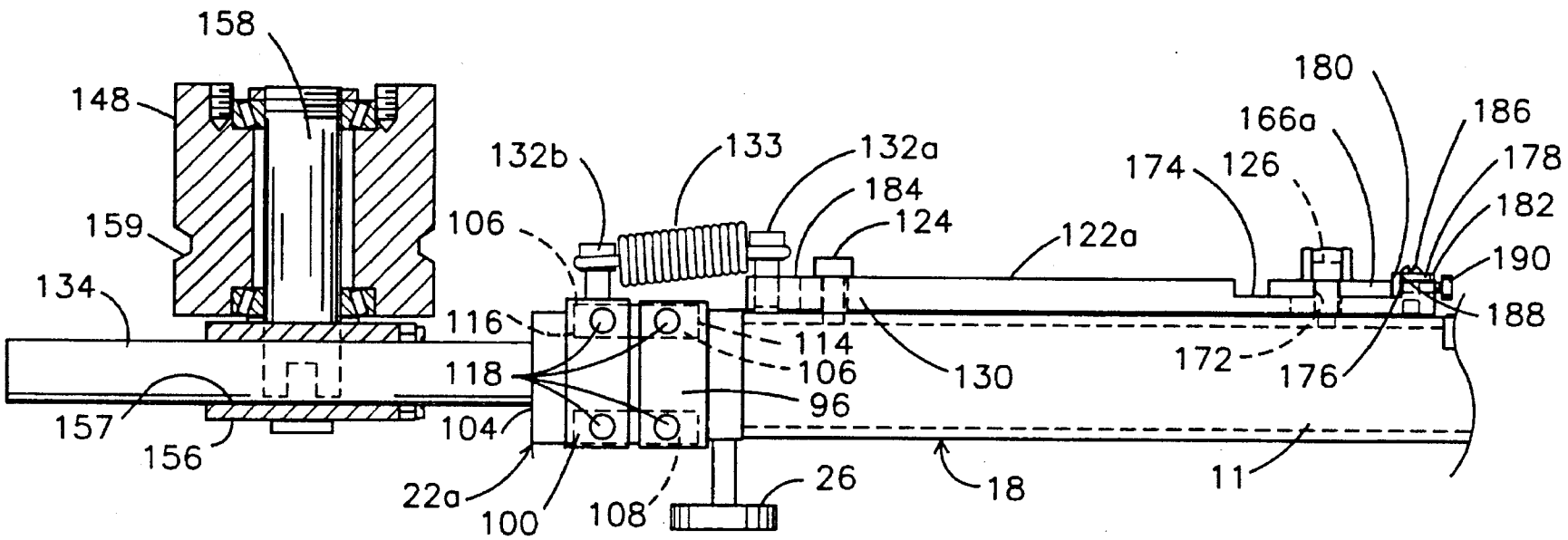
FIG. 7 is a detailed front elevational view of the invention as shown in FIG. 5.
Figure 8:
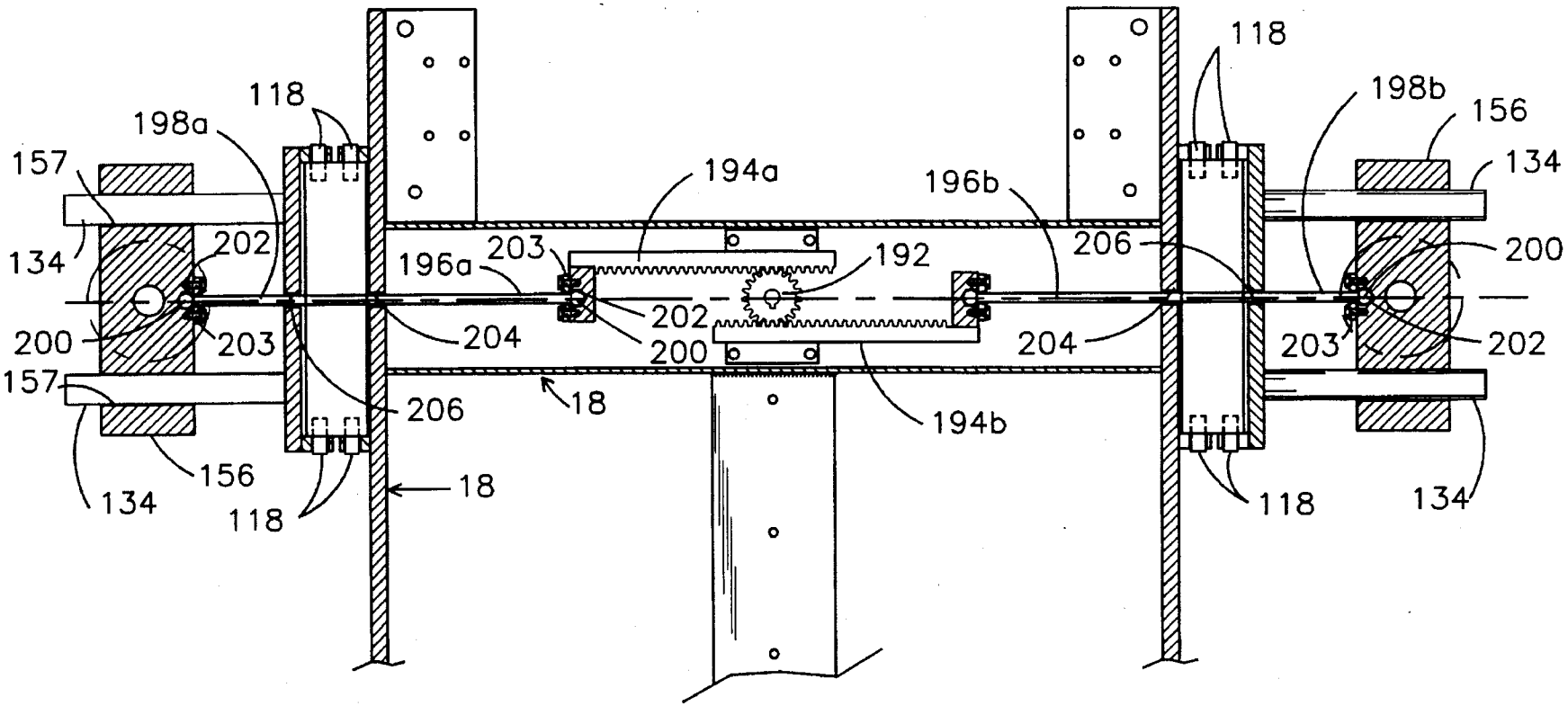
FIG. 8 is a cross-sectional plan view taken along lines 8—8 of FIG. 2.
Figure 9:
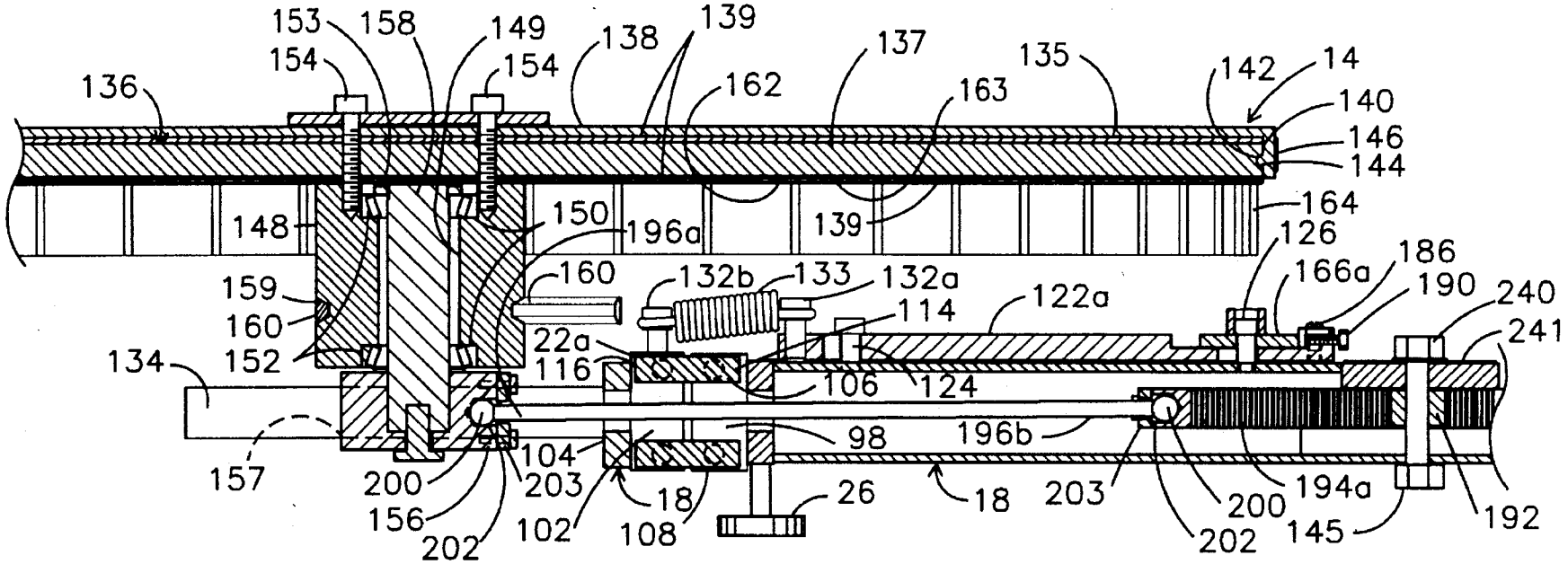
FIG. 9 is a detailed cross-sectional front elevational view taken along 9—9 of FIG. 3, illustrating a lifting means in the setup position.
Figure 10:
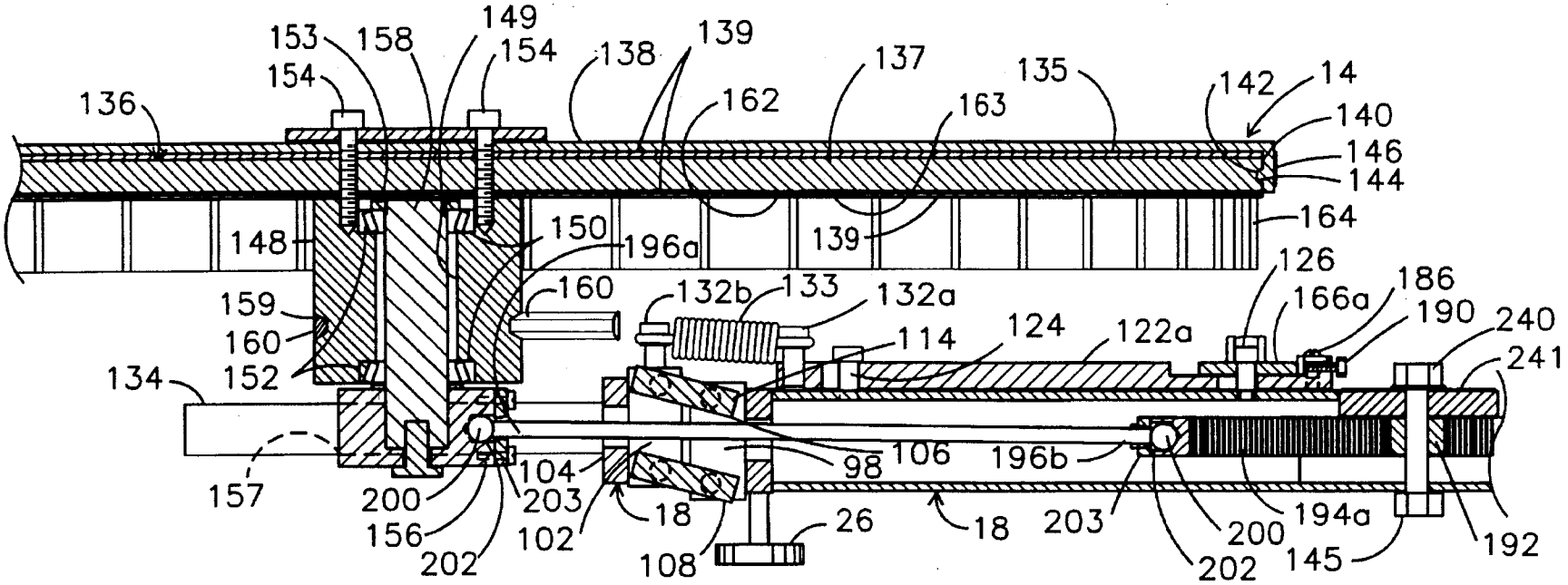
FIG. 10 is the detailed cross-sectional front elevational view of FIG. 9 illustrating the lifting means in the up position.

In the preferred embodiment, a lifting force may be applied to the two turntables 14 and 16 by the lifting means **22*a* and 22*b*. Since the lifting means 22*a* and 22*b* are identical in structure and operation, being mirror images of one another, only lifting means 22*a* will be described, as shown in FIGS. 5–10. The lifting means 22*a* comprises a first and a second leaf mount 96 and 98 respectively that are attached to the frame 18. A third and fourth leaf mount 100 and 102 respectively are connected to the turntable 14. As shown in FIG. 5, leaf mount 100 and 102 are attached to turntable mount support beam 104. As seen in FIG. 7, a first leaf 106 and a second leaf 108 are spaced apart from one another and are oriented generally parallel to one another. As seen in FIG. 5, the first leaf 106 has a first end 110, a second end 112, a first edge 114 and a second edge 116. A portion of the first end 110 and a portion of the second end 112 of first leaf 106 that are adjacent the first edge 114 are pivotally attached to the first leaf mount 96 and the second leaf mount 98 respectively. Portions of the first end 110 and the second end 112 that are adjacent the second edge 116 are pivotally attached to the third leaf mount 100 and the fourth leaf mount 102 respectively. The second leaf 108, seen more clearly in FIGS. 9 and 10, is attached in the same manner to the first, second, third, and fourth leaf mounts. The leaves 106 and 108 may be attached to the leaf mounts 96, 98, 100 and 102 by pins 118 that are inserted into holes 120 through each leaf mount as shown in FIGS. 5–7**.

The lifting means **22*a* further comprises a tensioning plate 122*a* which is slidably attached to the frame 18 by a pair of body bolts 124 and 126 which pass through slots 128 in the tensioning plate 122*a* and are threadably attached to the frame 18. When the body bolts 124 and 126 are attached to the frame, the tensioning plate 122*a* is permitted free movement within the limits of the slots 128. In the preferred embodiment, three posts 132*a* are attached proximal to the first end 130 of the tensioning plate 122*a*, and three shorter posts 132*b* are attached to the first leaf 106 adjacent the second edge 116. A biasing means, conveniently a spring 133 extends between each pair of corresponding posts 132*a* and 132*b*. The springs are sized depending on the preferred upward force to be applied by the lifting means 22*a*. In a preferred embodiment, the springs 133 are comprised of wire having a diameter of ⅛". Each spring is pretensioned to 20 pounds and has a rate of 80 pounds per inch. When the tensioning plate 122***a* is moved inwardly of the exercise apparatus 10, the first leaf 106 is pivoted about the axis of the pins 118 that are inserted in the first leaf mount 96 and the second leaf mount 98 as seen in FIGS. 6 and 10. This pivoting movement causes the turntable mount support beam 104 and the turntable 14 that is connected thereto, to move vertically upwardly.

In a preferred embodiment as illustrated in FIGS. 1–12 a pair of turntable mount supports 134 are attached to each turntable mount support beam 104 so that they are generally normal thereto and extend outwardly therefrom. Each turntable, 14 and 16 is slidably attached to a corresponding one of the turntable supports 134.

The first turntable 14 and the second turntable 16 are mirror images of one another; therefore, only turntable 14 will be described. As seen in FIGS. 9 and 10, the first turntable 14 comprises a flat, generally circular platform 136, which is made from compressed particle board 137 with a melamine layer 139 laminated to each side of the platform 136 providing a top surface 135 with a low coefficient of friction. Other suitable materials, including, but not limited to, metal and plastics may be used as a substitute for particle board 137 and melamine layer 139. A cover 138 is attached to platform 137. The cover 138 preferably extends over the edge 140 of the platform 136 so that a ridge 142 formed proximal to the periphery of the cover 138 is received in a groove 144 formed in the edge 140 of the platform 136. A tape 146 is tightly wrapped around the edge 140 of the platform 136 to keep the cover 138 firmly attached to the platform 136. In a preferred embodiment the cover 138 is a polyurethane material having a thickness of 1/16" and a shore hardness value of 40. In other embodiments, other thicknesses may be used but the shore value must be adjusted accordingly to provide the correct amount of flexibility. For example, when a layer of 1/32" polyurethane is used to form the cover 138, the shore hardness value must be increased to 60 to prevent excessive stretching of the cover 138. Thin covers of polyurethane are less expensive, but thin covers are more susceptible to damage. Polyurethane is the preferred material for the cover 138 as it provides sufficient friction to prevent the bicycle tires 236 and 238 from slipping and yet allows minimal wear to the tires 236 and 238 that would be caused by the shear force generated on the tires 236 and 238 by the circular movement of the turntables 14 and 16 during rotation. The polyurethane deforms and follows the tire path, thus, allowing insignificant wear to the tires 236 and 238. The melamine layer 139 provides an interface with the polyurethane cover 138 that has a low coefficient of friction enabling the cover 138 to deform.

The first turntable 14, as shown in FIGS. 9 and 10, further comprises a hub 148 with a hole 149 therethrough and a pair of counter bored holes 150 bored into each hole 149. A tapered bearing 152 is inserted in each counter-bored hole 150. A turntable mount 156 is slidably attached to the turntable mount supports 134 for movement therealong. The turntable mount 156 may be a solid unit with holes 157 therethrough that are sized and configured to receive the turntable mount supports 134 therein. The turntable mount 156 further comprises a turntable mount shaft 158 extending vertically upwardly therefrom and is threaded on the top end. The turntable mount shaft 158 passes through the tapered bearings 152 and is secured therein by a nut 153. Turntable 14 is mounted to the hub 148 by bolts 154 for rotation of the turntable 14 thereon. The hub 148 has a circumferential and horizontal groove 159 formed therein to receive a V-belt 160. The V-belt extends about both hubs 148 to provide a means for rotating both turntables 14 and 16 simultaneously when a force is applied to only one of the two turntables.

A tensioning mechanism 161, as seen in FIG. 3, maintains the tension on the V-belt 160 and is adjustable so that the proper tension in the belt 160 is reestablished when the turntables 14 and 16 are moved inwardly toward one another, and so that the belt 160 may be extended when the turntables 14 and 16 are moved away from one another to compensate for different bicycle sizes. A pulley 163*a* is slidably mounted on a pair of pulley tensioning shafts 165 that are mounted to the frame 18. Two additional pulleys 163*b* and 163*c* are mounted to the frame 18 on either side of the tensioning mechanism 161 to respectively direct the V-belt 160 toward and away from the tensioning mechanism 161. As slack is required in the V-belt 160 for adjustment of the distance between the turntables 14 and 16, the pulley 163*a* is moved inwardly and then outwardly to reestablish the proper tension in the V-belt 160. The pulley 163*a* is clamped to the pulley tensioning shafts by set screws or other well known means. The pulleys 163*a*, 163*b*, and 163*c* are secured to their shafts by snap rings or other well known means.

On the bottom surface 162 of the turntable 14 is mounted a fan plate 163 containing a plurality of fan blades 164 that channel air therebetween as the turntable 14 rotates creating a resistance to that rotation. In a preferred embodiment, as illustrated in FIGS. 3 and 9, there are 55 fan blades 164 that are attached by welding, or other well known means, to the fan plate 163 that is attached to the turntable 14. Each fan blade 164 has an arc of 120° and a radius of curvature of approximately 2 inches. The fan blades are arranged so that when a radius extending from axis A passes through the end of a fan blade 164 proximal to the periphery of the turntable 14, the other end of the fan blade trails the radius line by 1/4". Many other configurations may be used to either increase or decrease the resistance to rotation as desired The fan blades 164 are made of metal, but plastic or any other suitable material may be used, keeping in mind the weight required for inertia. As previously mentioned, turntable 16 is constructed as a mirror image of turntable 14 and comprises the same parts with the same reference numbers.

The lifting means 22*a* and 22*b* further comprise a means for engaging and disengaging the lifting means and a means for independently adjusting the initial leveling position of the turntables 14 and 16. The means for selectively engaging and disengaging the lifting means 22*a* and 22*b*, comprises conveniently, cam 166*a* and cam 166*b*, respectively, seen most clearly in FIGS. 5–7 and in FIGS. 1 and 3. In FIG. 5 it can be seen that the cam 166*a* is a generally rectangular plate having a first side 168 and a second side 170. The cam 166*a* has a hole 172 therethrough, through which is received the second body bolt 126 which passes through a hollow hex nut 173 that is welded to the cam 166*a*. The tensioning plate 122*a* has an inset portion 174 that creates a shoulder 176 in the tensioning plate 122*a*. An angle 178 having a first leg 180 and a second leg 182 is attached to the top surface 184 of the tensioning plate 122*a* by screws 186 that are inserted through slots 188 in the second leg 182 of the angle 178. The angle 178 is so mounted that the first leg 180 extends downwardly and parallel to the shoulder 176. The angle 178 is held in a free to move position, within the constraints of slots 188, by the screws 186. A screw 190 is threadably inserted through the tensioning plate 122 so that the screw extends through the shoulder 176 and engages the first leg 180 of the angle 178. Moving the first leg 180 away from the shoulder 176 increases the force being applied to the corresponding turntable connected thereto. Therefore, it is possible to make adjustments compensating for spring variations for leveling turntables 14 and 16 in the initial setup.

The distance between the bolt 126 and the first side 168 of the cam 166*a* is less than the distance between the bolt 126 and the second side of the cam 170. As shown in FIG. 5, the cam 166*a* is mounted with the first side 168 adjacent the first leg 180 of the angle 178, the setup position of the lifting means 22*a*. By rotating the cam the second side 170 of the cam engages the first leg 180 of the angle 178 pushing the tensioning plate 122 inwardly of the exercise apparatus 10. This movement extends the springs 133 rotating the leaves 106 and 108 and lifting the turntable 14, applying an upward force on each bicycle tire 236 and 238, defining the up position of the lifting means 22*a*. The force applied to either turntable 14 or 16 is determined by the height of the posts 132*b*. By threadably raising or lowering posts 132*b*, the moment arm of the force applied to the leaf 106 is decreased or increased respectively. The height of 136 for turntable 14 is gradually ½" and for turntable 16 the height of post 132*b* is ¾". In this manner, a different upward force may be applied by each turntable 14 and 16. Again, the apparatus just described, including cam 166*a* and the angle 178 are formed as a mirror image on the tensioning plate 122*b* that is connected to the second turntable 16 as seen in FIG. 3. Therefore, by rotating the cam 166*a* a lifting force can be applied to turntable 14, and, by rotating the cam 166*b*, a different lifting force may be separately applied to the second turntable 16.

Since the distances between the axes of bicycle wheels vary, it is necessary to provide a means for lengthening or shortening the distance between the vertical axis A and A' of the turntables 14 and 16 respectively. FIG. 8 discloses a pinion gear 192 that is rotatably attached to the frame 18. A pair of opposing racks 194*a* and 194*b* are aligned longitudinally with the frame 18. A rack arm 196*a* and a rack arm 196*b* are attached to the corresponding racks 194*a* and 194*b* and extend outwardly therefrom so that the first ends 198*a* and 198*b* are connected to the turntable mount 156. To ensure that the turntable mount 156 slide freely on their respective turntable mount supports 134, the rack arms 196*a* and 196*b*are longitudinally aligned with the axis B. In a preferred embodiment, the first ends 198*a* and 198*b* of rack arms 196*a* and 196*b*, respectively, have a ball 200 attached thereto which drops into a hole 202 in the turntable mount 156 and is held in position with the plate 203. The rack arms 196*a* and 196*b* pass through apertures 204 in the frame 18 and apertures 206 in turntable support beam 104. These apertures 204 and 206 are elongated in the vertical direction to provide clearance for the flexible rack arms 196*a* and 196*b* as the first ends 198*a* and 198*b* move upwardly and downwardly with the turntables 14 and 16 respectively. A gauge 241 is attached to bolt 240 so that the increased/decreased distance between turntables 14 and 16 may be calibrated thereon in relation to the rotation of bolt 240.

Figure 12:
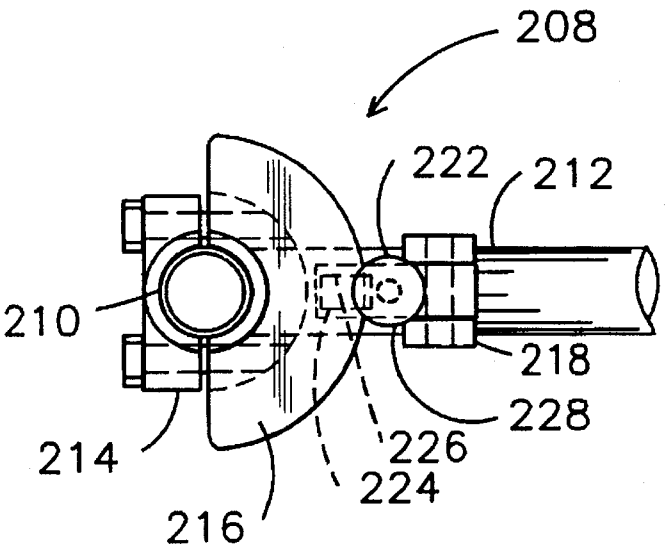
FIG. 12 is a top plan view of the handle bar stabilizer of FIG. 11. Similar reference characters refer to similar parts throughout the several views of the drawings.
Figure 11:
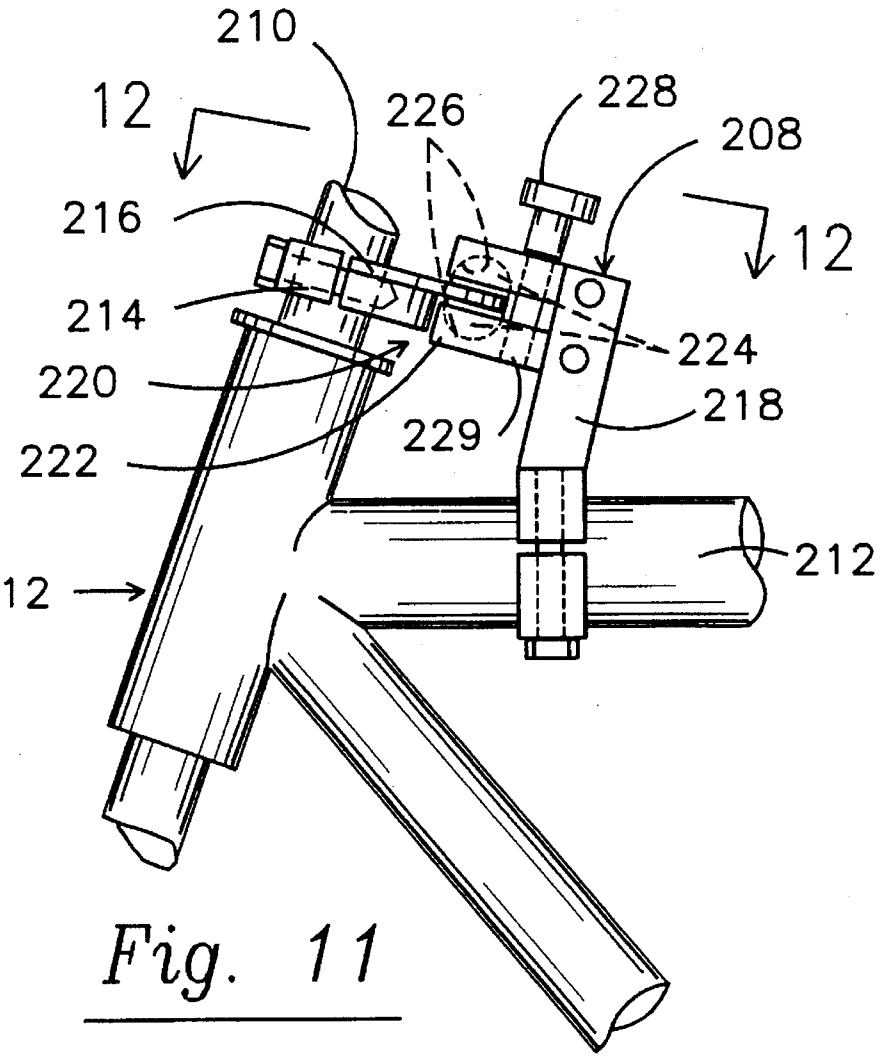
FIG. 11 is a front elevational view of the handle bar stabilizer illustrating its attachment to a bicycle.

FIGS. 11 and 12 illustrate a handlebar stabilizer shown generally as 208 that is designed to be attached to the handle bar stem 210 and the top tube 212 of the bicycle 12. The handle bar stabilizer 208 comprises a first part, comprising a first bracket 214 which is clamped to the handle bar stem 210 and a rotor 216 that extends outwardly from the first bracket 214. A second part comprising a second bracket 218 that is clamped to and extends from the top tube 212 and a caliper 220 that is mounted to the second bracket 218 so that the rotor 216 is received between the caliper arms 222. A shoe 224 having a curved bottom is inserted within each a curved recess 226 that is formed within each caliper arm 222. A brake knob 228 is attached to the caliper arms 222 by a threaded shaft 229 that is passed through a hole in one caliper arm and is threadably attached to the other. By turning the knob the caliper arms 222 squeeze the shoes 224 against the rotor 216 providing a braking action that increases the force necessary to turn the handle bars of the bicycle 12 stabilizing the handlebars.

Having thus set forth a preferred construction for the exercise apparatus 10 of this invention, it is to be remembered that this is but a preferred embodiment. Attention is invited to a description of the use of the exercise apparatus 10. To set up the exercise apparatus 10 for use requires that first the measured instance inches of the axis G and F of bicycle 12 be known. The turntables 14 and 16 must be properly spaced apart to receive the bicycle 12. The pinion gear 192, as seen in FIG. 8, must be rotated in a clockwise direction to decrease the spacing, moving the turntables to a retracted position, or in a counter clockwise direction to increase the spacing between turntables 14 and 16, moving the turntables toward an extended position. A bolt 240 may be attached to the pinion gear so that the bolt 240 extends upwardly through the apparatus frame 18 for easy access, as shown if FIGS. 1,3 and 5. By observing dial 241 the correct distance may be set. The tension be on belt 160 will also have to be adjusted.

The bicycle 12 is mounted on the support means 20. As seen in FIGS. 2 and 4, the bicycle bracket 230 of the bicycle 12 (the rotating assembly for pedaling) is placed upon the angle 78 of the support means 20. The bicycle down tube 232 is placed between the first part 74 and the second part 73 of the clamp 72 which is positioned by sliding the bolt 66 along the second slot 58. Now bolts 66 and 70 may be tightened. Each arm 76 of the support means 20 is attached the rear fork 234 by straps, metal clamps, or other well known means. With the bicycle attached to the mounting means 20, the front tire 236 and the rear tire 238 should be lightly contacting their corresponding turntables 14 and 16. If not, locking bolt 52 should be loosened and the shaft 48 lowered into the sleeve 40 until the tires 236 and 238 make proper contact. If only one tire is making contact then the support means 20 must be adjusted. Fine adjustments can be made by rotation of the leveling screws 82 to level the bicycle 12 so that both tires are contacting the corresponding turntables. The support reference post 84 may now be adjusted so that the second end 94 makes contact with the base 34 of the support means 20. If it is desired to raise the tires 236 and 238 upwardly from the turntables 14 and 16, the bolt 52 may be loosened and the mounting plate raised upwardly and re-locked by tightening bolt 52. The reference post 84 will remain at its selected length so that by loosening bolt 52 shaft 48 may be lowered again into the sleeve 40 until the second end 94 of the support reference post contacts the base 34 reestablishing the previously adjusted position of the bicycle tires 236 and 238 in vertical relationship to the turntables 14 and 16. For proper operation, as shown in FIG. 1, the axis G of the front wheel 29 of the bicycle 12 should be approximately ⅜" to ⅝" inwardly of the apparatus 10 from the center line E extending from the vertical axis A so that it is generally normal to the longitudinal axis B of the apparatus 10. If the turntables 14 and 16 are spaced the proper distance relative to the bicycle 12, it follows that the axis F of the rear wheel 31 of the bicycle 12 should be approximately ⅜" to ⅝" outwardly of the apparatus 10 from the center line D extending from the vertical axis A so that it is generally normal to the longitudinal. If the spacing is not correct between the turntables 14 and 16 and the axes G and F are not in the proper locations, minor adjustments may be made to the mounting means 20 by loosening bolt 60 and sliding the mounting plate 54 in the direction the bicycle 12 needs to be moved to obtain the ⅜" to ⅝" spacing otherwise the spacing of the turntable 14 and 16 will have to be readjusted.

In order to effectively operate the exercise apparatus 10 it is necessary to apply an upward force on the front tire 236 of approximately 25 to 35 pounds and a force of approximately 40 to 50 pounds on the rear tire 238 of the bicycle 12. This is accomplished by rotating the cams 166*a* and 166*b* from the set-up position, in which side 168 of the cam 166 engages the angle 178, to the up position, in which side 170 engages the angle 178. The strength of the lifting force is primarily determined by the size and number of springs 133 that are used, the size of the cams 166*a* and 166*b*, and the height of the post 132*b*. The lifting force on each tire 236 and 238 should be relatively constant; therefore, the lifting means 22*a* and 22*b* provide this via the vertical movement of the leaf mounts 96, 98, 100, and 102.

The exercise apparatus 10 is now ready to be used. The rider (not shown) pulls the bicycle outwardly so that the base 34 is adjacent the first end 30 of the rail support member 28. The tires 236 and 238 are now located near the periphery of the turntables 14 and 16 respectively. The rider then mounts the bicycle and commences pedaling against the inertia of turntables 14 and 16, resistance generated by moving air through and by the fan blades 164 and by the inertia of the weight of the mechanical parts of the apparatus 10. By adjusting the handlebar stabilizer 208, the rider can stabilize the orientation of the front wheel 29 of the bicycle 12 without requiring his hands to remain on the handle bars. By turning the handlebars to the right, the bicycle will move inwardly sliding the support means 20 on the linear bearing 36 along the bearing rail 38. A long moment arm H, as shown in FIG. 1, extends from the axis A' to the point of contact of the rear tire 238 (where the pedaling force of the rider is applied to the turntable 16) when the bicycle is near the periphery of the turntables 14 and 16. By moving the bicycle 12 inwardly toward the central axis A and A' of the turntables 14 and 16 respectively, as shown in phantom, the moment arm H, is shortened to H' requiring increased effort by the rider to rotate the turntable 16 and turntable 14 which is connected to turntable 16 by V-belt 160. This increased effort simulates the increased effort required when riding up a hill as much as a 10% grade or equal to the encounter of a strong headwind. The rider may move inwardly and outwardly, with little effort on his part, increasing or decreasing the moment arm H so that the operation of the exercise apparatus is very similar to the operation of a bicycle outdoors. It is apparent that one may make outwardly reducing the pedaling and have the benefit of the inertia of the turntables 14 and 16 providing the sensation of reaching the crest of a hill and the descending with little effort, thus giving the true sensation of outside biking.

It will thus be seen that the objects set forth above among those made apparent from the proceeding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall between.

Now that the invention has been described,

What is claimed is:

1. An exercise apparatus for use in combination with a bicycle having a handle bar, a top tube and a pair of wheels, said apparatus comprising:

a frame;

a first turntable and a second turntable rotatably connected to said frame, each turntable having a top surface and said turntables being connected to one another for simultaneous rotation;

support means for support of a bicycle, said support means being slidably attached to said frame for movement along a line between said first turntable and said second turntable, such that when a bicycle is mounted thereon, each wheel of the pair of wheels of the bicycle engage a corresponding one of said first and second turntables.

2. An exercise apparatus as in claim 1 further comprising:

two lifting means for selectively providing an upward force to a corresponding one of said turntables, each said lifting means being attached to said frame and connected to said corresponding one of said turntables.

3. An exercise apparatus as in claim 2 wherein said lifting means comprises:

a first and a second leaf mount attached to said frame and a third and a fourth leaf mount connected to one of said turntables;

a first leaf and a second leaf spaced apart from one another and generally parallel to one another, each said leaf having a first end and a second end, a first longitudinal edge and a second longitudinal edge, said first and second ends of said first leaf being pivotally attached to a corresponding one of said first and second leaf mounts, said first and second ends of said second leaf, being pivotally attached to a corresponding one of said first and second leaf mounts, said first and second ends of said first leaf, being pivotally attached to a corresponding one of said third and fourth leaf mounts, and said first and second ends of said second leaf being pivotally attached to a corresponding one of said third and fourth leaf mounts; and a biasing means connected to said frame and connected to said first leaf adjacent to said second longitudinal edge of said first leaf such that said second longitudinal edge of said first and second leaves are selectively biased to pivot in an upward direction, whereby said third and fourth leaf mounts and said connected turntable are selectively biased for upward generally vertical movement.

4. An exercise apparatus as in claim 3 wherein said biasing means comprises at least one spring, and each said lifting means further comprises:

a tensioning plate having a first end and a second end, said tensioning plate being slidably attached to said frame and said first end of said tensioning plate being attached to one end of said spring and the other end of said spring being connected proximal to said second edge of said first leaf, said tensioning plate having an inset portion forming a shoulder in said tensioning plate proximal said second end of said tensioning plate, said inset portion having a hole therethrough;

a cam rotatably mounted to said frame through said hole in said inset portion, said cam having a first side and a second side, said second side being spaced apart from the axis of rotation of said cam further than said first side is spaced apart therefrom such that when said first side of said cam engages said shoulder a set-up position is defined and when said second side of said cam engages said shoulder an up position is defined, whereby rotation of said cam between said set-up position and said up position respectively extends and contracts said spring respectively raising and lowering said connected turntable.

5. An exercise apparatus as in claim 4 wherein said lifting means further comprises:

a post having a first end and a second end, said first end of said post being adjustably and extendably attached to said first leaf such that said post extends upwardly therefrom, one end of said spring being attached to said second end of said post such that moving said post between an extended position and a retracted position increases the force applied by the turntable to the adjacent tire of the bicycle and moving said post between said retracted position and said extended position decreases the force.

6. An exercise apparatus as in claim 1 further comprising:

at least one turntable mount support extending longitudinally parallel to the center line extending between the axes of the turntables, said turntable mount support being connected to said frame, one of said turntables being slidably mounted on said turntable mount support, a pinion gear having teeth thereon, being rotatably mounted to said frame, a rack having a rack arm connected to said one turntable and said rack having teeth thereon for engagement with said teeth of said pinion gear such that rotation of said pinion gear moves said rack, rack arm and attached turntable between an extended position and a retracted position.

7. An exercise apparatus as in claim 1 wherein each said turntable has a top surface and a peripheral edge, each said turntable comprising:

a cover lying adjacent said top surface and being attached to said peripheral edge of said turntable, said cover being comprised of polyurethane.

8. An exercise apparatus as in claim 7 wherein the polyurethane material of said cover has a durometer reading of generally 40 on the shore scale for a thickness of said cover of generally one sixteenth of an inch.

9. An exercise apparatus as in claim 7 wherein the polyurethane material of said cover has a durometer reading of generally 60 on the shore scale for a thickness of said cover of generally one thirty-second of an inch.

10. An exercise apparatus as in claim 7 wherein:

said top surface of each said turntable is comprised of a smooth surface having a low coefficient of friction.

11. An exercise apparatus as in claim 1 further comprising:

a handle bar stabilizer for attachment to the bicycle, said stabilizer comprising;

a first part for attachment to the handlebars of the bicycle; and a second part for attachment to the top tube of the bicycle, said first and second parts selectively frictionally engaging one another between a first position defined as when said handle bars move freely in relation to said top tube and a second position, defined as when said handle bars are fixed in relation to said top tube.

* * * * *